US012168920B2

(12) United States Patent
Almarri et al.

(10) Patent No.: US 12,168,920 B2
(45) Date of Patent: Dec. 17, 2024

(54) METHOD OF INCREASING HYDROCARBON RECOVERY FROM A WELLBORE PENETRATING A TIGHT HYDROCARBON FORMATION BY A HYDRO-JETTING TOOL THAT JETS A THERMALLY CONTROLLED FLUID

(71) Applicant: SAUDI ARABIAN OIL COMPANY, Dhahran (SA)

(72) Inventors: Misfer J. Almarri, Dammam (SA); Murtadha J. AlTammar, Dhahran (SA); Khalid Mohammed Alruwaili, Dammam (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/818,910

(22) Filed: Aug. 10, 2022

(65) Prior Publication Data

US 2024/0052735 A1 Feb. 15, 2024

(51) Int. Cl.
*E21B 43/16* (2006.01)
*E21B 43/26* (2006.01)

(52) U.S. Cl.
CPC ..... *E21B 43/16* (2013.01); *E21B 43/26* (2013.01)

(58) Field of Classification Search
CPC ..... E21B 43/16; E21B 43/26
See application file for complete search history.

(56) References Cited

U.S. PATENT DOCUMENTS 10,227,825 B2 * 3/2019 Randall ..... E21B 41/0078
2005/0211439 A1 * 9/2005 Willett ..... E21B 43/114 166/308.1

(Continued)

FOREIGN PATENT DOCUMENTS

CN 109025940 B 12/2019
EP 2310767 B1 4/2016
WO 2021236690 A1 11/2021

OTHER PUBLICATIONS

A. Briner et al.; "Impact of Wellbore Completion Type on Fracture Initiation Pressure in Maximum Tensile Stress Criterion Model for Tight Gas Field in the Sultanate of Oman", IPTC-18261-MS; International Petroleum Technology Conference; Dec. 2015; pp. 1-12 (12 pages).

(Continued)

*Primary Examiner* — James G Sayre
(74) *Attorney, Agent, or Firm* — Osha Bergman Watanabe & Burton LLP

(57) ABSTRACT

A method of increasing hydrocarbon recovery from a wellbore penetrating a tight hydrocarbon formation is disclosed. The method involves inserting a hydro-jetting tool into the wellbore; jetting a thermally controlled fluid against the wall of the wellbore to create a cavity in the wall, using the hydro-jetting tool; injecting, using the hydro-jetting tool, a further amount of the thermally controlled fluid into the wellbore such that the pressure in the wellbore increases, wherein the increased pressure creates a fracture from the cavity, wherein injecting the further amount of the thermally controlled fluid cools the tight hydrocarbon formation surrounding the cavity by circulating the thermally controlled fluid within the cavity; withdrawing the hydro-jetting tool (Continued)

from the wellbore; and recovering the thermally controlled fluid and the hydrocarbons escaped from the fracture in the formation.

14 Claims, 7 Drawing Sheets

(56) References Cited

U.S. PATENT DOCUMENTS

| | | | | |
|---|---|---|---|---|
| 2006/0201674 | A1* | 9/2006 | Soliman | E21B 43/2605 166/308.1 |
| 2011/0061869 | A1* | 3/2011 | Abass | E21B 43/26 166/308.1 |
| 2012/0118568 | A1* | 5/2012 | Kleefisch | E21B 7/14 166/297 |
| 2018/0320497 | A1* | 11/2018 | Garcia | E21B 44/00 |
| 2021/0363868 | A1* | 11/2021 | Almarri | E21B 37/00 |

OTHER PUBLICATIONS

J. Chavez et al.; "Formation Breakdown Prediction for the Implementation of Hydraulic Fracturing on a HPHT Tight Gas Reservoir in Oman", SPE 164012; Society of Petroleum Engineers; Jan. 2013; pp. 1-8 (8 pages).

M. Oparin et al.; "Impact of Local Stress Heterogeneity on Fracture Initiation in Unconventional Reservoirs: A Case Study from Saudi Arabia", Sep. 2016; pp. 1-18 (18 pages).

A. Sakhaee-Pour and A. Agrawal; "Predicting Breakdown Pressure and Breakdown Cycle in Cyclic Fracturing", SPE 191137; Society of Petroleum Engineers; Nov. 2018; pp. 761-769 (9 pages).

A. F. Ibrahim and H. Nasr-El-Din; "Evaluation of the Breakdown Pressure to Initiate Hydraulic Fractures of Tight Sandstone and Shale Formations", SPE-191245-MS; Society of Petroleum Engineers; Jun. 2018; pp. 1-19 (19 pages).

A. M. Gomaa et al.; "New Insights into Hydraulic Fracturing of Shale Formations", IPTC 17594; International Petroleum Technology Conference; Jan. 2014; pp. 1-17 (17 pages).

M. J. AlTammar et al.; "Application of Different Fluid Injection Methods to Reduce Breakdown", IPTC-19589-MS; International Petroleum Technology Conference; Jan. 2020; pp. 1-14 (14 pages).

Misfer Almarri; "Identification and characterization of Thermally Induced Fractures through integrated analytical and semi-analytical models", Journal of Petroleum Science and Engineering; vol. 196; Oct. 13, 2020; pp. 1-20 (20 pages).

Misfer Almarri; "Efficient History Matching of Thermally Induced Fractures Using Coupled Geomechanics and Reservoir Simulation", Energies; vol. 13; No. 3001; Jun. 11, 2020; pp. 1-43 (43 pages).

A. Al-Nakhli et al.; "Reducing Breakdown Pressure of Tight Reservoirs via in-Situ Pulses: Impact of Mineralogy", SPE-196540-MS; Society of Petroleum Engineers; Oct. 2019; pp. 1-12 (12 pages).

"SugiFrac® Service", Aug. 9, 2022; p. 1; Retrieved from the Internet: URL: https://cdn.brandfolder.io/5U67IG4F/as/c5863kq8kv89t9t35hgshfrz/SurgiFrac_Service.pdf (1 page).

E. Peters et al.; "Consequences of thermal fracture developments due to injection of cold CO2 into depleted gas fields", Energy Procedia; 2013; pp. 1-18 (18 pages).

V. Vilarrasa and Lyesse Laloui; "Impacts of thermally induced stresses on fracture stability during geological storage of CO2", Energy Procedia; vol. 86; 2016; pp. 411-419 (9 pages).

E.J.L. Koning; "Fractured Water Injection Wells—Analytical Modelling of Fracture Propagation", SPE 14684; Society of Petroleum Engineers; Aug. 1985; pp. 1-58 (58 pages).

A.J. Simpson and R.W. Paige; "Advances in Forties Field Water Injection", SPE 23140; Society of Petroleum Engineers; Sep. 1991; pp. 355-368 (14 pages).

D G Stevens & L R Murray; "Predicting Multiple Thermal Fractures in Horizontal Injection Wells; Coupling of a Wellbore and a Reservoir Simulator", SPE 59354; Society of Petroleum Engineers; Apr. 2000; pp. 1-9 (9 pages).

International Search Report issued in corresponding International Application No. PCT/US2023/029759; mailed Nov. 3, 2023 (6 pages).

Written Opinion of the International Searching Authority issued in corresponding International Application No. PCT/US2023/029759; dated Nov. 3, 2023 (10 pages).

* cited by examiner

METHOD OF INCREASING HYDROCARBON RECOVERY FROM A WELLBORE PENETRATING A TIGHT HYDROCARBON FORMATION BY A HYDRO-JETTING TOOL THAT JETS A THERMALLY CONTROLLED FLUID

BACKGROUND

Hydrocarbon reservoirs with reserves trapped within formations with lower permeability, such as certain tight sandstone, carbonate, and/or shale formations, exhibit little or no production, and are thus economically undesirable to develop at low oil and gas prices.

Well stimulation is one method that is frequently employed to increase the net permeability of a formation or reservoir, thereby leading to increased production from wells that have little or no production. Oil and gas wells in tight reservoirs are stimulated by hydraulic fracturing, also called fracking, which is a process in which a fracturing fluid is injected into a wellbore under pressure until the fracturing fluid breaks or cracks the rock in fractures.

Fracturing is a field practice to enhance production from otherwise uneconomic wells and allows for increased hydrocarbon recovery from hydrocarbon formations. Fracturing processes may be carried out using completions that will isolate a part of a vertical or horizontal well section, perforate casing if the well is cased, and then pump the fracturing fluid to initiate and propagate fractures in one or more lateral extensions which create new or additional flow channels through which hydrocarbons may more readily move from the formation into a producing wellbore.

Hydraulic fracturing is a stimulation treatment performed on oil and gas wells in reservoirs with a low permeability. Specially engineered fracturing fluids are pumped at high pressure and rate into the reservoir causing a vertical fracture to open. The wings of the fracture extend away from the wellbore in opposing directions according to the natural stresses within the formation.

Breakdown pressure is the pressure at which a rock matrix (finer grained particles between larger particles) of an exposed formation fractures and allows the fracturing fluid to be injected. The breakdown pressure is established before determining reservoir treatment parameters. Hydraulic fracturing is conducted above the breakdown pressure, while matrix stimulation treatments are performed with the treatment pressure safely below the breakdown pressure.

Deep tight hydrocarbon reservoirs with over-pressured and very competent rocks make the hydraulic fracturing operations very challenging because of high breakdown pressure. High breakdown pressure is one of the major challenges in reservoirs with highly stressed regimes, low permeability, in deep, and a high pressure, high temperature (HPHT) environment. These conditions may leave a small window to break down the formation and initiate fractures due to exceeding pumping limitations or completion tubular pressure ratings. Inability to breakdown the formation may result in skipping hydraulic fracturing stages. This will cause the cost of operations to increase, the operation efficiency and the hydrocarbon recovery to decrease. Several solutions and techniques are proposed in the industry to reduce high breakdown pressure in tight gas reservoirs. These techniques include cyclic fracturing, low viscosity fracturing fluid, perforations, and high pressurization rate. However, the high breakdown pressure in tight gas reservoirs still present a persistent challenge.

One way to address this challenge is by cooling down the formation to reduce in-situ stresses resulting from the weight of the overlying rocks, and subsequently reduce breakdown pressure and increase hydraulic fracturing efficiency. However, injecting cooling fluid to cool down the temperature of the formation prior to fracturing is not always possible due to limited well injectivity.

Accordingly, there exists a need for a method of increasing hydrocarbon recovery from a wellbore penetrating a tight hydrocarbon formation by a hydro-jetting tool that jets a thermally controlled fluid.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a method of increasing hydrocarbon recovery from a wellbore penetrating a tight hydrocarbon formation, comprising: inserting a hydro-jetting tool into the wellbore; jetting a thermally controlled fluid against the wall of the wellbore to create a cavity in the wall, using the hydro-jetting tool; injecting, using the hydro-jetting tool, a further amount of the thermally controlled fluid into the wellbore such that the pressure in the wellbore increases, wherein the increased pressure creates a fracture from the cavity, wherein injecting the further amount of the thermally controlled fluid cools the tight hydrocarbon formation surrounding the cavity by circulating the thermally controlled fluid within the cavity; withdrawing the hydro-jetting tool from the wellbore; and recovering the thermally controlled fluid and the hydrocarbons escaped from the fracture in the formation.

Other aspects and advantages of the claimed subject matter will be apparent from the following description and the appended claims.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In one aspect, embodiments disclosed herein relate to a method of increasing hydrocarbon recovery from a wellbore penetrating a tight hydrocarbon formation, comprising: inserting a hydro-jetting tool into the wellbore; using the hydro-jetting tool for: jetting a thermally controlled fluid against the wall of the wellbore to create a cavity in the wall, injecting a further volume of the thermally controlled fluid into the wellbore such that the pressure in the wellbore increases and the increased pressure creates a fracture from the cavity, wherein injecting the further volume cools the tight hydrocarbon formation surrounding the cavity by circulating the thermally controlled fluid within the cavity, withdrawing the hydro-jetting tool from the wellbore, and recovering the thermally controlled fluid and the hydrocarbons escaped from the fracture in the formation.

Embodiments of the present disclosure may provide at least one of the following advantages. The hydro-jetting tool jets a thermally controlled fluid to perforate a cavity in the tight hydrocarbon formation. Immediately after the cavity is perforated, a stimulation treatment is followed with the same thermally controlled fluid to propagate fractures from the perforated cavity. The fractures are propagated through simultaneous injection of proppant-laden slurry down the coiled tubing and clean fluid down the annulus. The formation breakdown and stimulation enables injection rates, where conventional fracturing treatments are not achievable due to poor well injectivity.

This method is cost effective without a need for mechanical isolation, subsequent interventions, or lower completion.

Figure 1:
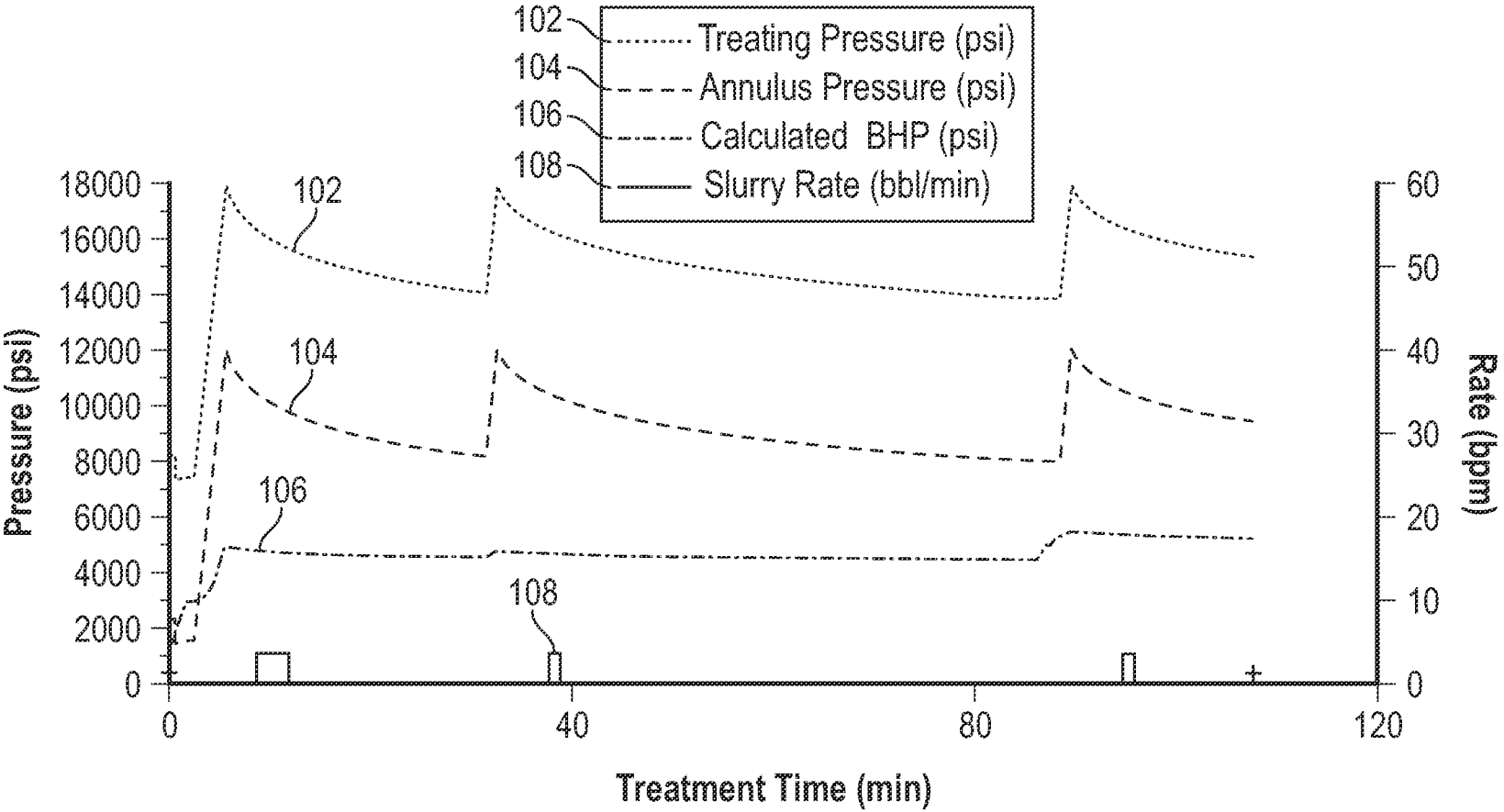
FIG. 1 shows a field case of one stage where three attempts of breaking the formation failed, according to one or more embodiments.

FIG. 1 shows graphs of pressures in psi as a function of the treatment time in minutes (min). The pressure is established by the hydro-jetting tool when injecting the thermally controlled fluid into the wellbore.

In staged fracturing, numerous reservoir intervals are hydraulically stimulated in succession. In shale gas reservoirs, staged hydraulic fracturing is performed in horizontal wellbores. The placement of perforated cavities and fracturing stages are optimized using geomechanical data to maximize gas production. The pressure is determined for a single stage of fracturing in tight gas sandstones reservoirs exhibiting high breakdown pressure.

Graph 102 shows the treating pressure as function of the treatment time. The treating pressure is the pressure used to inject the thermally controlled fluid into the wellbore to extend the cavities in fractures.

Graph 104 shows the annulus pressure (annular pressure) as function of the treatment time. The annular pressure is the pressure in the annulus between the production tubing used to produce reservoir fluids form the wellbore and production casing set across the reservoir interval.

Alternatively, the annular pressure is the pressure in the annulus between two casing strings through which the reservoir fluids are produced to the surface.

Graph 106 shows the calculated bottomhole pressure (BHP) as a function of the treatment time.

The fractures propagate when the bottomhole pressure (BHP) exceeds the breakdown pressure. Therefore, BHP is a measure of the formation breakdown pressure. The BHP required to break down the formation is reduced due to the cooling of the formation. This is indicates that the cooling of the formation has an impact on the formation breakdown pressure. The BHP is calculated in a static, fluid-filled wellbore with the equation:

$$BHP=MW*\text{depth}*0.052,$$

where BHP is the bottomhole pressure in pounds per square inch (psi), MW is the mud weight in pounds per gallon, depth is the true vertical depth in feet, and 0.052 is a conversion factor if these units of measure are used.

Graph 108 shows the slurry rate in barrel/min (bbl/min) as function of the treatment time. A slurry is a mixture of suspended solids and liquids.

The slurry rate demonstrates the limited capability of injection at normal rates. An injectivity of less than 5 bbl/min is achievable for a very limited period of time while reaching wellbore tubular limitations. This signifies that it is not possible to inject at higher slurry rates and hence, not possible to break down and fracture the formation.

As can be seen from the various graphs of FIG. 1, for the specific field case depicted, three attempts of breaking or fracture the formation failed.

Figure 2:
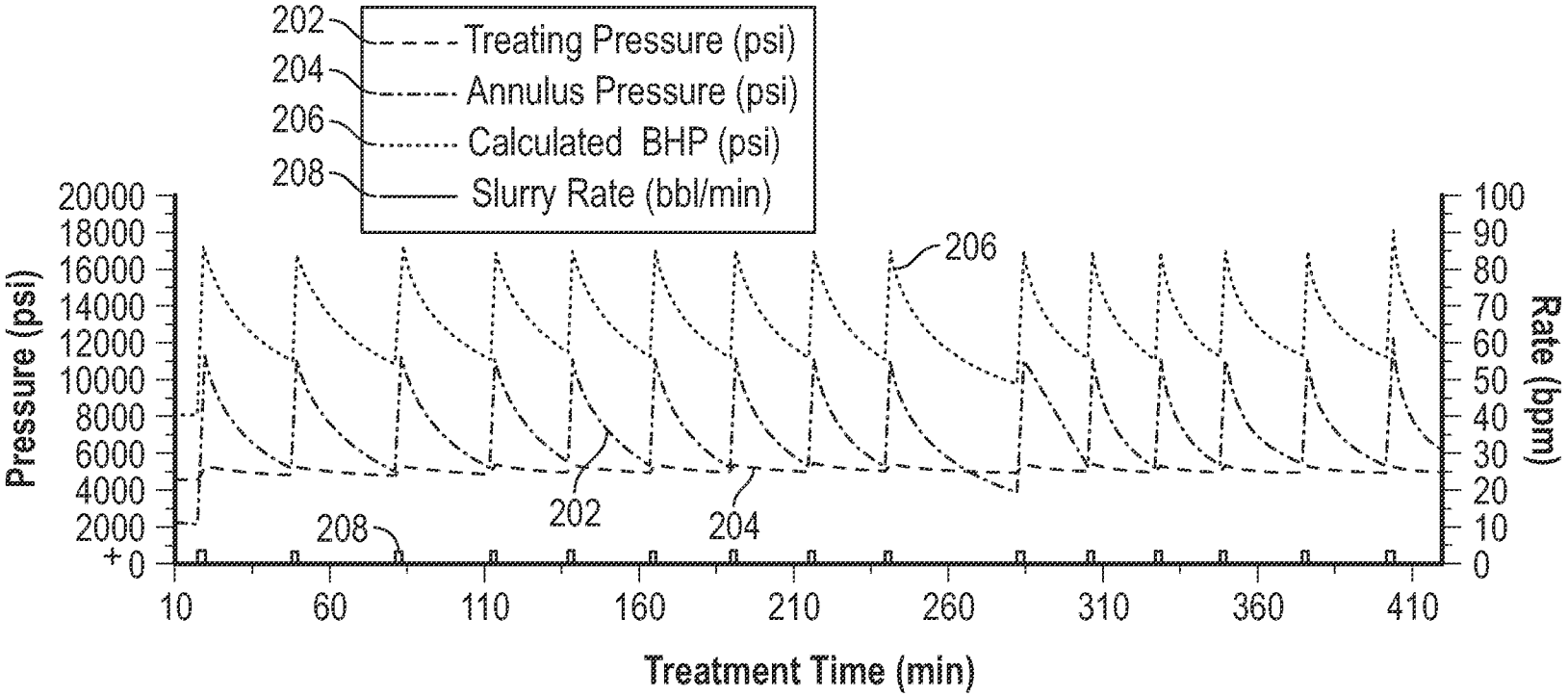
FIG. 2 shows another field case of one stage where multiple-hour pressure cycling was unsuccessful in breaking down the formation, according to one or more embodiments.

FIG. 2 shows a second field case of one stage where multiple-hour pressure cycling was unsuccessful in breaking the formation down.

Reducing the formation temperature and cooling the formation has a large impact on the reduction of the in-situ stress and breakdown pressure. This results from the thermoelasticity of the formation material that becomes more elastic at lower temperatures.

This impact in waterflooding formations (formations in which water is injected into the reservoir to displace residual oil) results from the temperature contrast between the injected thermally controlled fluid and the formation.

The reduction of in-situ stress and breakdown pressure utilizes thermally controlled fluids.

The tight gas reservoir may be modeled by box modeling. Box modeling is a 3D modeling where a box is used to create the shape of the tight gas reservoir as a final model. Therefore, box modeling uses a number of repetitive steps. A simulated box model of a tight gas reservoir shows that the tight gas reservoir includes low permeability of 0.06 and (millidarcy) and low porosity of 6%. And that the formation temperature is 150° C. (300° F.) and that the minimum horizontal stress gradient is 0.7 psi/ft. The formation temperature in the near wellbore area is reduced to −7° C. (20° F.), 5° C. (40° F.), and 15° C. (60° F.) in different simulations of the box model.

As can be seen from the graphs of FIG. 2, for the specific field case depicted, pressure cycling for several hours also failed to break or fracture the formation.

Figure 3:
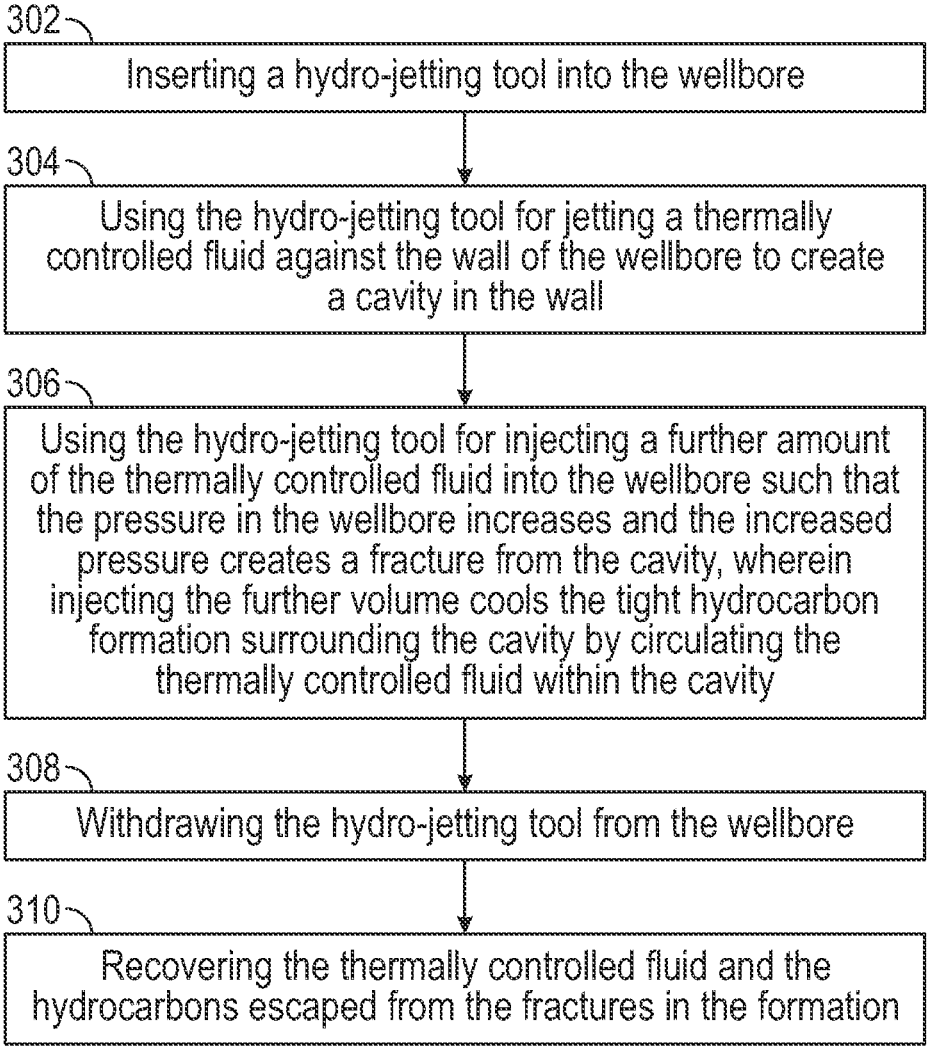
FIG. 3 shows a flowchart of the method steps of increasing hydrocarbon recovery from a wellbore penetrating a tight hydrocarbon formation by a hydro-jetting tool that jets a thermally controlled fluid, according to one or more embodiments.

FIG. 3 shows a flowchart of the method steps of increasing hydrocarbon recovery from a wellbore penetrating a tight hydrocarbon formation by a hydro-jetting tool that jets a thermally controlled fluid, according to one or more embodiments.

Initially, in step 302, the hydro-jetting tool is inserted into the wellbore. In some embodiments, a lubricating fluid is injected into the wellbore before the hydro-jetting tool is inserted into the wellbore. In some embodiment, the lubricating fluid has a viscosity ranging from about 1 to 10,000 centipoise. In some embodiments, the lubricating fluid includes drilling fluid (mud). In some embodiments, the lubricating fluid further includes an amide-based additive for the reduction of torque and drag in water-based drilling fluids without having an effect on the stability of the drilling fluid. The lubricating fluid maintains stability and performance at temperatures up to 400° F. (204° C.). Furthermore, the lubricating fluid reduces friction between the metallic body parts of the hydro-jetting tool and the rocks forming the inner wall of the wellbore. The lubricating fluid further reduces frictional torque and drag and improves the lubrication of water-based drilling fluids.

In step 304, the hydro-jetting tool is used for jetting a thermally controlled fluid against the wall of the wellbore to create a cavity in the wall. The cavity may be a hole, a new perforation or a channel that is created by the thermally controlled fluid that is pumped through the jetting tool. This thermally controlled fluid impinges on the formation, creating a cavity. As the cavity is formed, pressure on the bottom of the cavity increases, eventually initiating a fracture.

Figure 4:
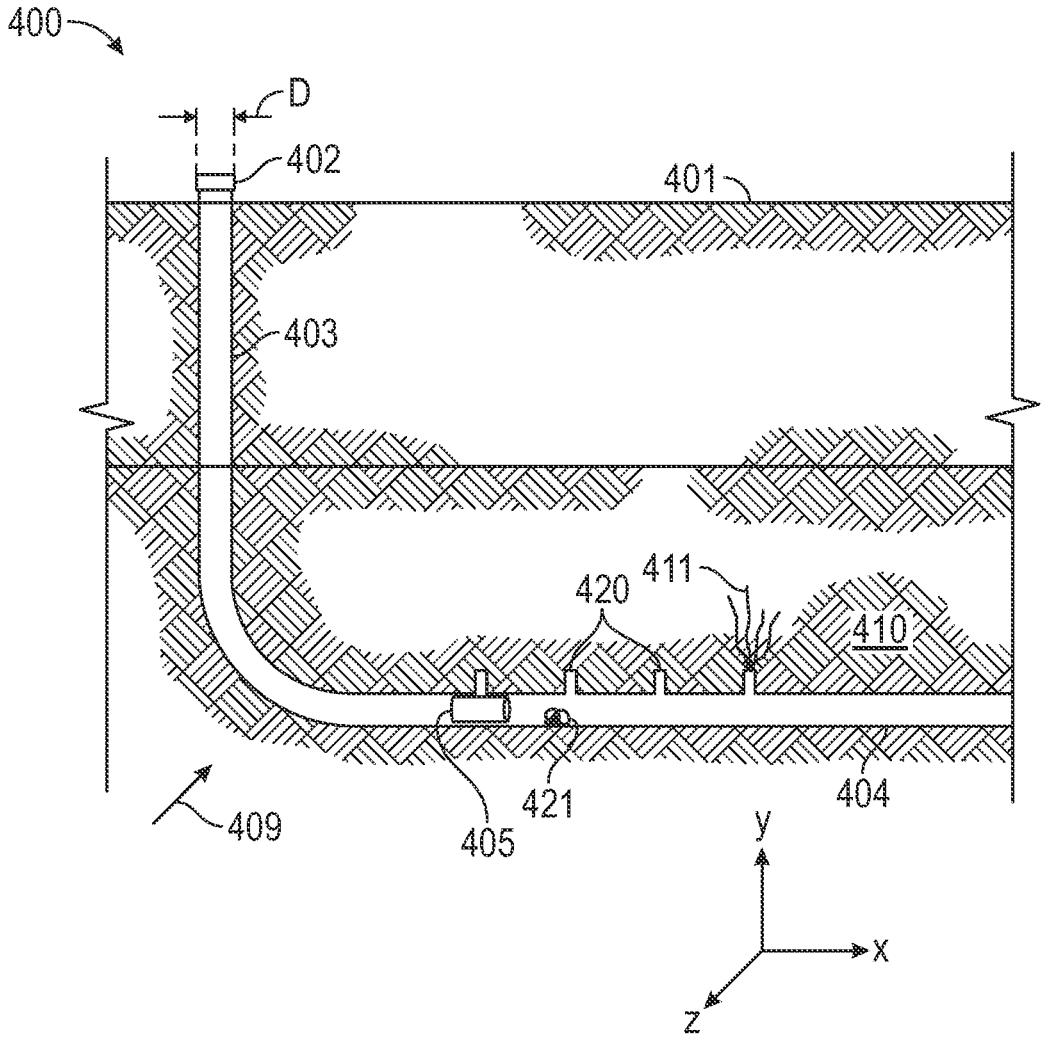
FIG. 4 shows a cross section of a tight hydrocarbon formation with a wellbore drilled into the formation, according to one or more embodiments.

FIG. 4 shows a cross section of a tight hydrocarbon formation 410 with a wellbore 402 drilled into the formation 410. The tight hydrocarbon formation 410 may be of the type located in the southern part of Saudi Arabia, Oman, Algeria, Australia, the UAE, or any other part of the world that may exhibit over-pressured, deep, very competent rocks. Over-pressured reservoirs are those above hydrostatic pore-pressure gradients. Deep reservoirs are those generally deeper than 12,000 ft. Competent rocks are those generally having a Young's Modular greater than about 6.0 Mpsi. The tight hydrocarbon formation 410 may exhibit a Young's modulus in the range of about 6-10 Mpsi and minimum stress gradients in the range of about 0.8-1.4 psi/ft. The tight hydrocarbon formation 410 may be any formation with a high breakdown pressure. The tight hydrocarbon formation 410 has a formation maximum horizontal stress 409, which may be in any direction on the x-z plane. In FIG. 4, the formation maximum horizontal stress 409 is directed along the z axis.

The wellbore 402 generally proceeds from surface 401 into the tight hydrocarbon formation 410. The wellbore 402 may be an open-hole recovery well, a cased-hole recovery well, or any other well generally known in the art. The wellbore 402 includes a vertical portion 403 and a horizontal portion 404, and has a wellbore diameter D. The vertical portion 403 includes substantially vertical portions, wherein the vertical portion is within 15° of being perpendicular to the surface 401. The horizontal portion 404 includes substantially horizontal portions, wherein the horizontal portion is within 15° of being perpendicular to the vertical portion 403 of the wellbore 402. The wellbore 402, the vertical portion 403, and the horizontal portion 404 may be formed by any method known in the art. Wellbore diameter D may be the same or vary between the vertical portion 403 and the horizontal portion 404.

One or more oriented cavities 420 are formed radially outward in the horizontal portion 404 of the wellbore 402. The oriented cavities 420 may be formed substantially perpendicular to the horizontal portion 404 of the wellbore 402. The term "substantially perpendicular" refers to deviating less than about 15° from perpendicular alignment with regard to the spatial orientation of two objects. In an embodiment, the oriented cavity 420 is substantially parallel to the vertical portion 403 of the wellbore 402. The term "substantially parallel" refers to deviating less than about 15° from parallel alignment with regard to the spatial orientation of two objects. In other embodiments, the oriented cavity 420 is in any direction substantially perpendicular to the horizontal portion 404 of the wellbore 402. The penetration of the oriented cavities 420 bypasses the near-wellbore skin. In an embodiment, the oriented cavities 420 extend radially outward from the horizontal portion 404 of the wellbore 402 at an approximate distance equal to or greater than one and a half times the wellbore diameter D; the distance, at least 1.5 D, of the oriented cavity 420 being considered from the initiation point of the oriented cavity 420 at an outer wall of the wellbore 402 and extending into tight hydrocarbon formation 410. In other embodiments, the oriented cavities 420 extend radially outward from the outer radius of the horizontal portion 404 of the wellbore 402 at an approximate distance equal to 1 foot, 1.5 feet, 2 feet, 2.5 feet, or 3 feet.

In an alternative embodiment, the orientated cavities 420 extend radially outward from the horizontal portion 404 of the wellbore 402 a distance great enough to overcome near-wellbore skin and stresses. Generally speaking, the further the oriented cavities 420 extend into the tight hydrocarbon formation 410, the more the stress influences from the horizontal portion 404 of the wellbore 402 are reduced. These influences include how the horizontal portion 404 of the wellbore 402 affects the stress state of the near-wellbore area in the formation surrounding the oriented cavities 420 during fracturing. If the oriented cavities 420 extend a distance of three times the diameter of the horizontal portion 404 of the wellbore 402 into the tight hydrocarbon formation 410, the influences from the horizontal portion 404 of the wellbore 402, including near wellbore stresses, become negligible. The oriented cavities 420 extending a distance of less than three times the diameter of the horizontal portion 404 of the wellbore 402 into the tight hydrocarbon formation 410 may still form transverse fractures and may still overcome near-wellbore stresses. In an embodiment, the near-wellbore stresses are overcome when the oriented cavity 420 extends a distance of at least one and a half times the wellbore diameter D into the tight hydrocarbon formation 410 from the outer radius of the horizontal portion 404 of the wellbore 402. In an embodiment, the oriented cavity 420 has any diameter. In another embodiment, the oriented cavity 420 has a diameter of at least approximately 2 inches. The oriented cavity 420 may be formed by any method known in the art.

The thermally controlled fluid may include a mixture of an abrasive material and water and may be at any temperature. In an embodiment, the abrasive material is sand. In an embodiment, the thermally controlled fluid includes a mixture of an erosive material and water. In an embodiment, the erosive material is sand. In an embodiment, the erosive material is acid. The acid may be hydrochloric acid, acetic acid, or any other acid with a pH less than 6.5. In general, the thermally controlled fluid needs to be compatible with the formation. Any thermally controlled fluid may be used, including aqueous solutions of potassium chloride liquids or other brines. In some embodiments, the thermally controlled fluid does not include viscosifying agents, viscous components, proppants, or binders. The thermally controlled fluid may be introduced into the wellbore 402 by any method known in the art. The thermally controlled fluid may be directed through a downhole tool 405.

In an embodiment, the thermally controlled fluid pressure is increased to approximately 2000 pounds per square inch (psi) to perform the jetting inside the horizontal portion 404 of the wellbore 402. In an embodiment, the pressure of the thermally controlled fluid is approximately in the range of 500 psi to 5,000 psi, or alternatively in the range of 500 psi to 2,250 psi, or alternatively in the range of 1,000 psi to 5,000 psi, or alternatively in the range of 1,000 psi to 2,000 psi, or alternatively in the range of 2,000 psi to 5,000 psi, or alternatively in the range of 1,500 psi to 2,250 psi.

The thermally controlled fluid is at a lower temperature than the tight hydrocarbon formation. The jetting does not pulverize and compact the formation and creates an oriented cavity 420 that is clean and unstressed. In an embodiment, debris 421 created by the jetting are carried away from inside the oriented cavity 420 through horizontal portion 404 and out of vertical portion 403, for example out through an annulus between wellbore 402 and downhole tool 405 (not pictured).

After one or many oriented cavities 420 are formed, the hydro-jetting tool injects the thermally controlled fluid into the wellbore 402 at an initial pressure and introduced into the oriented cavities 420 of the horizontal portion 404 of the wellbore 402. In general, the thermally controlled fluid used should be compatible with the formation. Any thermally controlled fluid may be used, including gases, such as $N_2$ and $CO_2$, and liquids, such as aqueous solutions of potassium chloride and other brines or liquid $CO_2$. In some embodiments, the thermally controlled fluid does not include viscosifying agents, viscous components, proppants, or binders. The temperature of the thermally controlled fluid is selected to be a temperature that would alter the temperature of the tight hydrocarbon formation 410 once the thermally controlled fluid is injected into the formation.

In some embodiments, the temperature of the thermally controlled fluid is chosen relative to the ambient surface temperature and the temperature of the formation. In an embodiment, the tight hydrocarbon formation 410 is at a temperature greater than an ambient temperature at the surface 401 of the wellbore 402, and the thermally controlled fluid is at a temperature at or lower than the ambient temperature at the surface 401. Therefore, in this embodiment, the thermally controlled fluid is kept at a temperature at or lower than the ambient temperature of the surface 401 and injected into the wellbore 402 in the horizontal portion 404 to cool the tight hydrocarbon formation 410 near the wellbore 402. In another embodiment, the tight hydrocarbon formation 410 is at a temperature lower than an ambient temperature at the surface 401 of the wellbore 402, and the thermally controlled fluid is at a temperature at or higher than the ambient temperature of the surface 401. Therefore, in this embodiment, the thermally controlled fluid is kept at a temperature at or above the ambient temperature of the surface 401 and injected into the wellbore 402 in the horizontal portion 404 to heat the tight hydrocarbon formation 410 near the wellbore 402.

In yet other embodiments, the temperature of the thermally controlled fluid is chosen based on the temperature of the tight hydrocarbon formation 410. In an embodiment, the temperature of the thermally controlled fluid is substantially lower than the temperature of the tight hydrocarbon formation 410 in order to cool the formation. In an embodiment, the temperature of the thermally controlled fluid is at least about 38° C. (100° F.) less than the temperature of the tight hydrocarbon formation 410, or alternately at least about 93° C. (200° F.) less, or alternately at least about 150° C. (300° F.) less. In another embodiment, the temperature of the thermally controlled fluid is greater than the temperature of the tight hydrocarbon formation 410 in order to heat the formation. In an embodiment, the temperature of the thermally controlled fluid is at least about 100° F. greater than the temperature of the tight hydrocarbon formation 410, or alternately at least about 200° F. greater, or alternately at least about 300° F. greater. In an embodiment, the thermally controlled fluid includes steam at a temperature higher than the temperature of the tight hydrocarbon formation 410. In some embodiments, the thermally controlled fluid has a temperature range of about −50° C. (−60° F.) to 5° C. (40° F.). In some embodiments, alternating hot and cold thermally controlled fluids may be injected at alternating intervals to induce temperature change shocks to reduce breakdown pressures and optionally generate fractures.

One purpose of the thermally controlled fluid is to induce thermal reduction of the in-situ stresses of the tight hydrocarbon formation 410. In an embodiment, the reduction of the stresses in the reservoir is achieved by holding the thermally controlled fluid in the horizontal portion 404 of the wellbore 402 for a sufficient time to cool or heat the reservoir. In some embodiments, the injection of the thermally controlled fluid initiates the formation of fractures 411. In some embodiments, low-temperature thermally controlled fluids are used in such applications cause instability in the formation with respect to tensile failure, and increased stress intensity at the fracture tip leading to fracture growth. Deeper penetration of the thermally controlled fluids into the reservoir and the reservoir exposure time are factors considered to induce thermal reduction of the in-situ stresses.

Modeling and simulation may be performed to determine the requirements of the thermally controlled fluid injection process. Although not shown, the modeling and simulation may be performed on any suitable computing device with one or more processors, as is known in the art. The required exposure time for the thermally controlled fluid depends on factors such as the thermally controlled fluid volume, the thermally controlled fluid temperature, and reservoir properties, including the rock type, formation composition, the thermal and petrophysical characteristics of the rock, in-situ stresses, and the geomechanical and geophysical properties of the formation. Advanced numerical model simulators may take the above factors into consideration to determine the required exposure time. In an embodiment, the method includes the determination, via modeling or simulation, of an amount of time that thermally controlled fluid would need to be injected into the wellbore 402 to change the temperature of the tight hydrocarbon formation 410 closest to the horizontal portion 404 of the wellbore 402 in order to reduce the stresses of the tight hydrocarbon formation 410 closest to the horizontal portion 404 of the wellbore 402, and then continuing to inject the thermally controlled fluid into the wellbore 402 for that amount of time, optionally allowing the thermally controlled fluid to sit for a period of time, or allowing for continuous injection and return via the use of a return annulus. For example, concentric coiled tubing may be applied in some embodiments for application of the thermally controlled fluid and its return.

The volume of the thermally controlled fluid and the amount of time the thermally controlled fluid must be held in the formation may be based on reservoir, mechanical, and thermal properties, among others. A reservoir cooldown analysis may be performed to determine the amount of cooling needed to reduce the reservoir stresses.

The temperature of the thermally controlled fluid may be altered via any method known in the art. In an embodiment, cooling systems, heat exchangers, or heaters on the surface 401 are used to alter the temperature of the thermally controlled fluid.

In step 306, the hydro-jetting tool is used for injecting a further amount of the thermally controlled fluid into the wellbore such that the pressure in the wellbore increases and the increased pressure creates a fracture from the cavity, wherein injecting the further amount/volume of fluid cools the tight hydrocarbon formation surrounding the cavity by circulating the thermally controlled fluid within the cavity. That is, annular thermally controlled fluid is pulled into the fracture, helping to extend the initial cavity formed.

In step 308, the hydro-jetting tool is withdrawn from the wellbore. The hydro-jetting tool is withdrawn in a similar manner than it is inserted into the wellbore (see step 302). In some embodiments, a lubricating fluid is injected into the wellbore before the hydro-jetting tool is withdrawn from the wellbore, wherein the lubricating fluid includes drilling fluid (mud) to maintain stability and performance at high temperatures and to reduce friction between the metallic body parts of the hydro-jetting tool and the rocks forming the inner wall of the wellbore. In one or more embodiments, the lubricating fluid used to insert the hydro-jetting tool into the wellbore is the same as the lubricating fluid used to withdraw the hydro-jetting tool from the wellbore.

Now turning to FIG. 4 again, the penetration of the oriented cavities 420 in the tight hydrocarbon formation 410 overcomes additional near-wellbore stresses, also allowing the thermally controlled fluid to effectively lower the in-situ stresses of the reservoir resulting in lower breakdown pressures and allowing for additional fracturing. Without the oriented cavities 420 penetrating the reservoir and bypassing the near-wellbore greater stress area, the thermally controlled fluid would reduce the in situ stresses, but possibly not enough to overcome the additional stresses generated in the near-wellbore area, which may result in the breakdown pressures still being too great compared to the tubular completion limits. Creation of a near-wellbore skin during drilling and completion leads to a new stress state which may further increase fracture initiation. The puncture of the near-wellbore skin by the oriented cavities addresses this issue. The deeper penetration of the cavity 420 is independent of stress direction and bypasses near-wellbore skin, which eliminates fracture tortuosity and improves fracture deliverability.

The oriented cavities 420 can, with an appropriate length as disclosed herein, replicate a "short" vertical well. Generally, in the fracturing of a vertical well, longitudinal fractures are more readily formed at lower pressure because of the stress state in the subterranean zone. Fractures generally propagate perpendicular to the minimum principal stress in the subterranean zone. Generally, the minimum principal stress is oriented horizontally; therefore, for a vertical wellbore, longitudinal fractures are more likely to form, and form at lower breakdown pressures. Therefore, the oriented cavities 420 in the horizontal portion 404 of the wellbore 402 serve as an initiation point for fractures 411, which may be longitudinal fractures, with respect to the oriented cavities 420. The fractures 411 propagate radially outwardly from the horizontal portion 404 of the wellbore 402 and oriented cavity 420, perpendicular to the minimum principal stress of the subterranean zone (x,z). The deeper penetration of the oriented cavity 420 into the tight hydrocarbon formation 410 synergistically decreases the pressure needed to initiate the fractures 411 in addition to the stress reduction obtained from cooling the reservoir.

The method then contemplates fracturing of the tight hydrocarbon formation 410 and generating fractures 411. During hydraulic fracturing operations, a thermally controlled fluid is pumped under a pressure and rate sufficient for cracking the reservoir formation and creating fractures. Fracturing may be performed by any method generally known in the art. The disclosed use of the oriented cavities 420 and the injection of the thermally controlled fluids lowers the breakdown pressure of the formation and results in fracturing the formation at lower pressures. In an embodiment, the injection of the thermally controlled fluid initiates the formation of fractures 411, which are further propagated by hydraulic fracturing. The fractures 411 may be generated in a planar configuration.

In an embodiment, fracturing is performed while isolating portions of the wellbore 402. In an embodiment, fracturing is performed without isolation of portions of the wellbore 402. Any suitable fracturing fluid may be used to perform fracturing, for example oil-based or water-based fluids with or without proppants. In an embodiment, the fracturing fluid is the same as the thermally controlled fluid. In an embodiment, the fracturing fluid is the same as the thermally controlled fluid. In an embodiment, the fracturing fluid is different from the thermally controlled fluid. In an embodiment, the fracturing fluid is different from the thermally controlled fluid.

The fractures 411 initiate in the tight hydrocarbon formation 410. The oriented cavity 420 provides a cavity similar to a weakened wellbore and promotes the creation a planar hydraulic fracture configuration. A minimum of one and a half wellbore diameter deep oriented cavities 420 assist in ensuring transverse fracture initiations.

The fractures 411 may be initiated along the weakest point in the oriented cavity 420 itself. The cavity 420 may be blocked with debris 421 if explosive perforating technology is used. Explosive perforating technology may create a tapering of the oriented cavity 420, where the oriented cavity 420 narrows as it extends from the entry hole at the horizontal portion 404 of the wellbore 402 to the tip of the oriented cavity 420 in the tight hydrocarbon formation 410. The explosive perforating technology may pulverize the formation surrounding the oriented cavity 420 and may compact the rock and debris inside the oriented cavity 420. The pulverized formation surrounding the oriented cavity 420 exists in an elevated stress state, such that when hydraulic pressure is applied, fracture face re-orientation may occur. In fracture face re-orientation, as the hydraulic fractures grow, the fractures no longer confine themselves to the fracture plane and instead re-orient themselves along a non-planar geometry. Fracture face re-orientation may be less likely to occur when the oriented cavity 420 has a reduced stress state due to the jetting because the jetting scours the formation rather than compacting it, does not leave the formation around the oriented cavity 420 in a stressed state, and removes debris 421 from the oriented cavity 420.

In another embodiment, the fractures 411 are generated generally in a direction of the formation maximum horizontal stress 409 of the tight hydrocarbon formation 410. The direction of the formation maximum horizontal stress 409 may be in any direction along the x-z plane. In an embodiment, the plurality of planar fractures 411 is generated transverse to the horizontal portion 404 of the wellbore 402. In an embodiment, the plurality of planar fractures 411 is generated transverse to the vertical portion 403 of the wellbore 402. In an embodiment, the plurality of planar fractures 411 is generated transverse to the oriented cavity 420.

Once the planar fractures 411 are generated, additional methods of increasing hydrocarbon recovery may occur. In an embodiment, proppant is introduced into the fractures 411. Any type of proppant may be used, such as sand, glass, or organic matter. In one or more embodiments, the proppant is introduced via the proppant-laden slurry. The proppant-laden slurry may be thermally controlled.

In step 310, the thermally controlled fluid and the hydrocarbons escaped from the fracture in the formation are recovered. In some embodiments, the thermally controlled fluid and the hydrocarbons are pumped by a submersible pump. In other embodiments, the thermally controlled fluid and the hydrocarbons flow out of the wellbore by natural pressure exerted on the fluids by the formation. The hydrocarbons need be separated from the thermally controlled fluid. The separation may be performed in centrifuge. In one or more embodiments, more thermally controlled fluid is poured into the wellbore during recovering of the hydrocarbon to maintain a low temperature in the wellbore.

Those skilled in the art will appreciate that any suitable jetting tool, such as the HydraJet™ abrasive jetting tool, may be used to form the cavities and fractures as described in FIGS. 3 and 4 above. Further, the jetting tool may use any suitable process, such as a dynamic diversion in accordance with the SurgiFrac process (discussed further in FIG. 7 below), to perforate the formation so that the jetting tool may be used to jet fluid into the formation to create further cavities/fractures.

Figure 5:
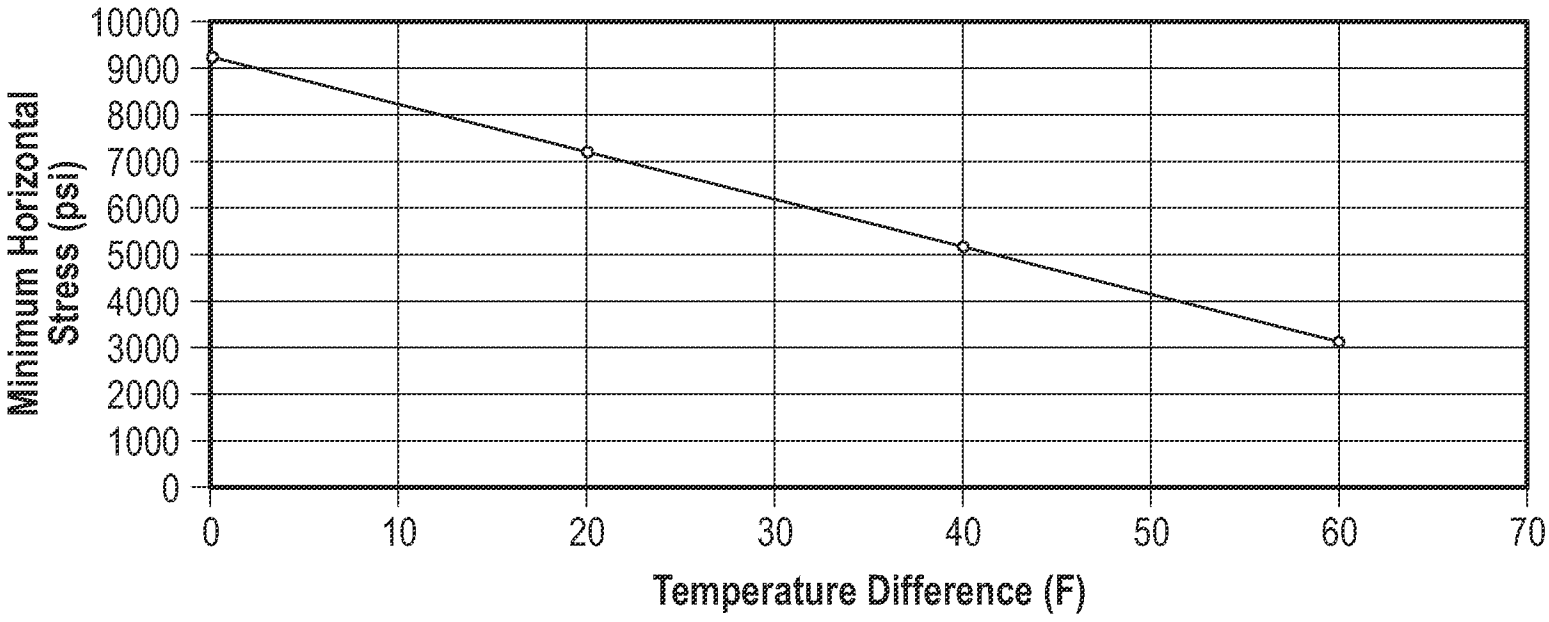
FIG. 5 shows total minimum horizontal stress reducing as the temperature difference increases, according to one or more embodiments.

FIG. 5 shows a graph of a simulation with the minimum horizontal stress as function of the temperature difference between the reservoir temperature before and after the treatment. The minimum horizontal stress is in psi and the temperature difference is in Fahrenheit F. As can be seen from the graph, the minimum horizontal stress reduces as the temperature difference increases, which means the cooler the well the lower the horizontal stress of the formation.

Figure 6:
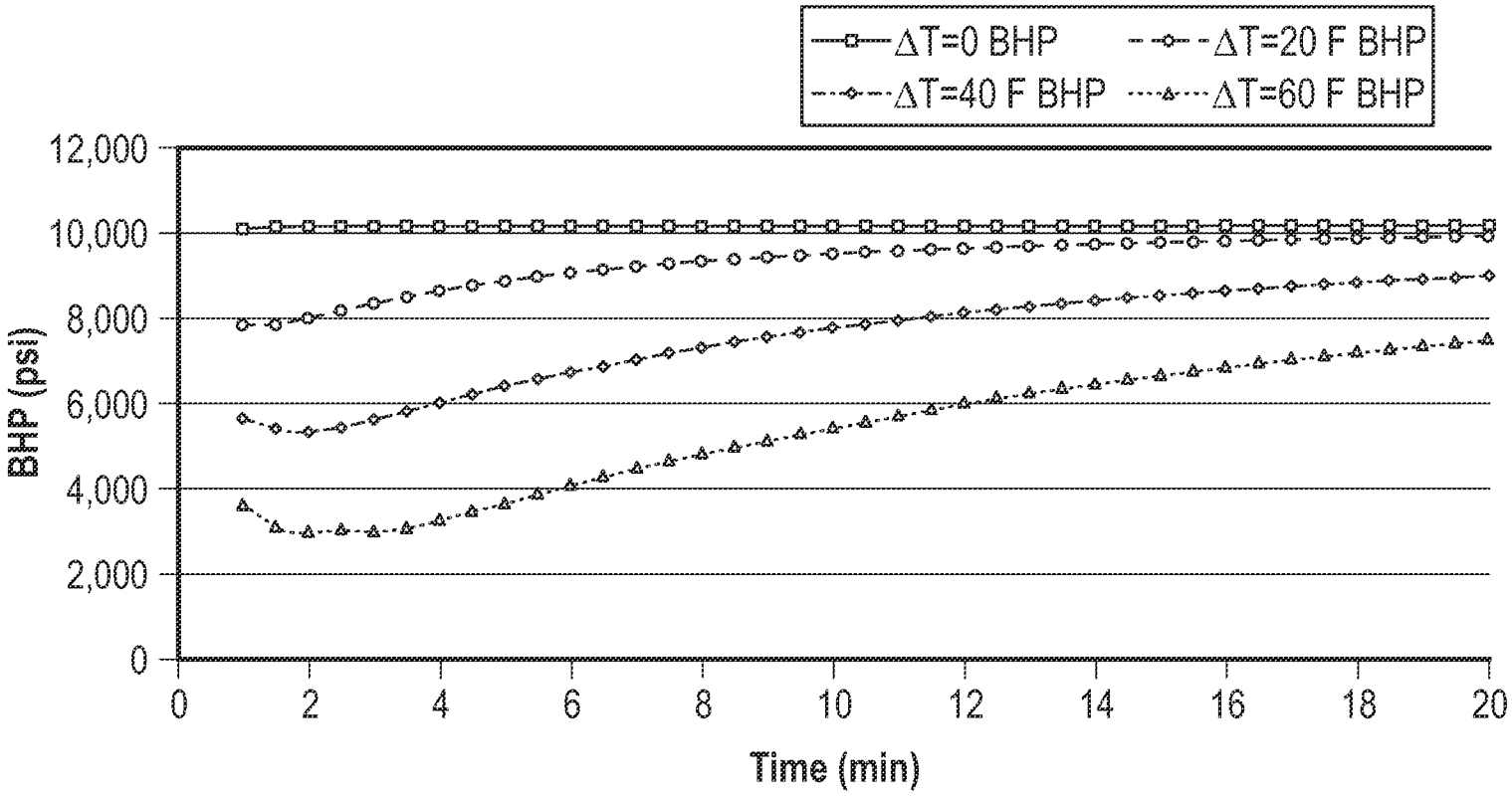
FIG. 6 shows the bottomhole pressure decreasing significantly as the temperature difference increases, according to one or more embodiments.

FIG. 6 shows a graph of the BHP needed to initiate the fractures as function of time. The BHP is in psi and the time is in minutes. As can be seen from the graph, the BHP needed to initiate the fractures decreases significantly as the temperature difference increases.

Figure 7:
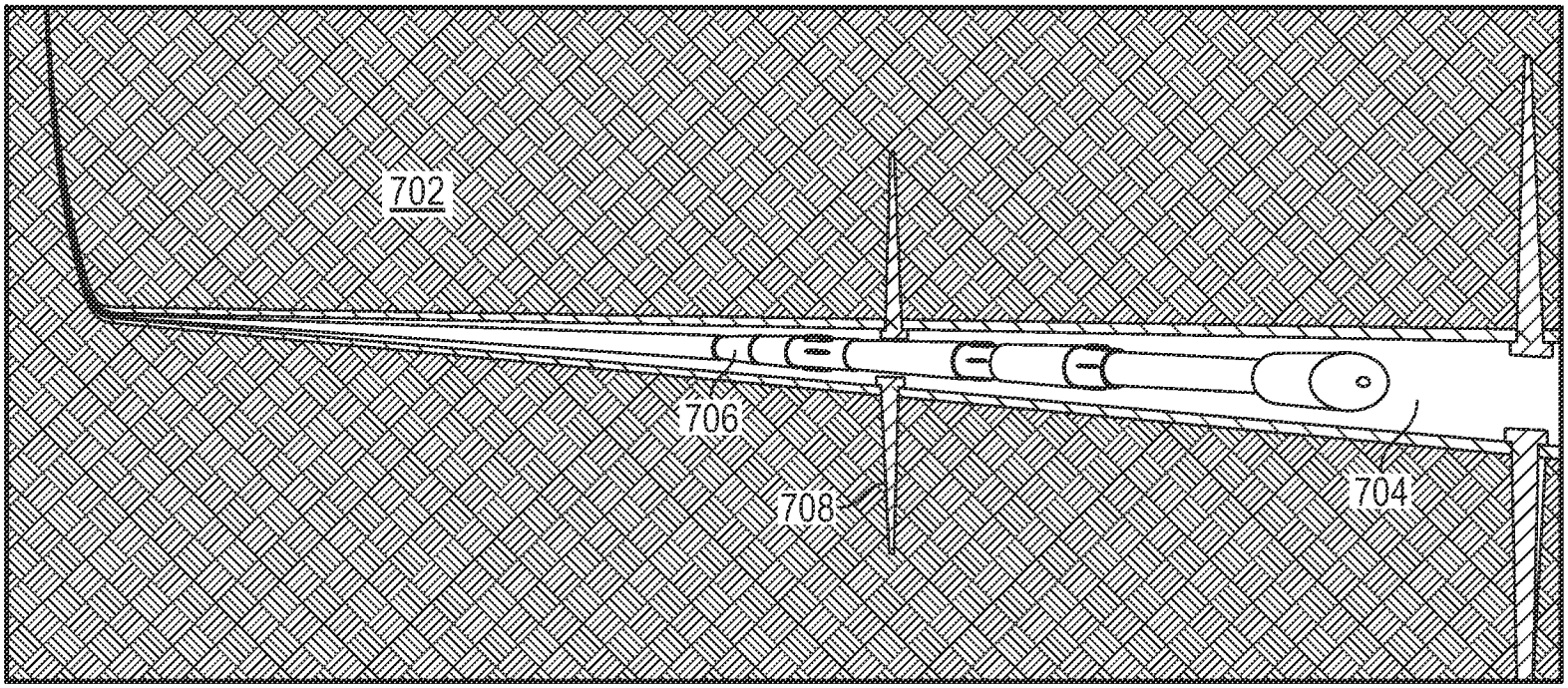
FIG. 7 shows a cross-section of a wellbore penetrating a formation with a hydro-jetting tool penetrating the wellbore, according to one or more embodiments.

FIG. 7 shows a cross-section of a formation 702 with a wellbore 704 penetrating the formation 702.

For optimal production, the jetting tool propagates a limited number of discrete fractures that are widely separated and well distributed. If too many fractures are propagated, the width and length of each are reduced as the number increases. The fractures are created only where they are needed. Multiple fractures in close proximity to each other improves the initial stimulation response. A high-rate, large-volume open-hole fracturing, results in extreme multiple fracturing that causes most of the treating fluid to be placed in one small area, leaving the rest of the interval essentially untreated. This result is desirable when the lateral well has very homogeneous formation properties and no zones are fractured during the drilling process.

In one or more embodiments, the jetting tool uses a dynamic diversion technique. That is, instead of using mechanical sealing or chemical blocks, the jetting tool uses the fluids' own dynamic movements to divert most of the fluid flow into a specific point in the formation. For the dynamic diversion technique, a carbonate zone is acidized or the proppant-laden slurry is used to achieve fracture conductivity. A small jetting tool is placed on the end of a treating string. Coiled tubing may be used to achieve a necessary rate of fracturing. Because this process generates only one fracture system at a time, the required pumping rate is not very high. The jetting tool is used initially to create a small, jetted cavity (tunnel) in the formation. The low sand concentrations in the jetting stage also allows the jetting tool to perforate a liner or cemented casing.

A hydro-jetting tool 706 is inserted into the wellbore 704. The hydro-jetting tool 706 pumps pressurized thermally controlled fluid into the wellbore that impinges on the formation from an inside of the well creating cavities. The pressure of the thermally controlled fluid depends on the properties of the formation, design requirements, and surface facility limitations. As the cavities are formed, pressure on the bottom of the cavities increases, initiating a fracture 708. Annular thermally controlled fluid is pulled into the fracture 708, helping to extend it.

The hydro-jetting tool 706 perforates cavities and then moves straight into the stimulation phase. As a perforated cavity is formed, pressure on the bottom of the cavity increases, eventually initiating the fracture 708. The thermally controlled fluid is pulled down the annulus into the fracture, helping to extend it. Stimulation fluid is simultaneously pumped down the tubing and annulus.

The thermally controlled fluid is used as a stimulation fluid to lower the breakdown pressure.

The cooling of the formation and lowering the breakdown pressure is implemented through the following steps. The first step involves creating a plurality of oriented cavities substantially perpendicular to the horizontal portion of the wellbore via jetting. Second step involves injecting a thermally controlled fluid into the wellbore, wherein the temperature of the thermally controlled fluid is selected to alter the temperature of the tight hydrocarbon formation. Third step involves fracturing the tight hydrocarbon formation by generating a plurality of planar fractures.

Then, the thermally controlled fluid is injected for a certain period of time to cool down further and finally fracturing the formation using the same thermally controlled fluid. The injection of the thermally controlled fluid may be performed in wellbores with a cemented metal casing placed and cemented (cased hole) or in uncased wells (open hole).

The hydro-jetting tool is compatible with acidizing, chemical injections, and proppant fracturing fluid applications. The hydro-jetting tool is a highly configurable assembly, with the ability to customize jet count and alignment, tool diameter, and even the incorporation of orienting tools to accommodate targeted stimulation operations.

In one or more embodiments, the thermally controlled fluid is carbon dioxide $CO_2$. Cold injection of carbon dioxide forms a cold region around the well. This temperature contrast may reduce the in-situ stresses considerably. The thermally induced fractures due to injection of cold carbon dioxide may have adverse impact on the caprock and faults activations, which may cause leakage of the carbon dioxide. This phenomenon, however, reduces the total minimum horizontal stress by increasing thermal stresses due to higher temperature difference between the injected thermally controlled fluid and the reservoir temperature.

Stress expresses the internal forces that neighboring particles of the tight hydrocarbon formation exert on each other.

The total minimum horizontal stress $\sigma_{T,min}$ in a formation depends on the temperature and pressure and is described by the following relationship:

$$\sigma_{T,min}=\sigma_{hmin,i}+\sigma_{\Delta T}+\sigma_{\Delta P}, \quad (1)$$

where $\sigma_{hmin,i}$ is the initial minimum horizontal stress, $\sigma_{\Delta T}$ is the thermoelastic stress, and $\sigma_{\Delta P}$ is the poroelastic stress.

The thermoelastic stress $\sigma_{\Delta T}$ is related to the effect of the temperature on the reservoir stress field whereas the poroelastic stress $\sigma_{\Delta P}$ is related to the effect of the pore pressure on the reservoir stress field. The thermoelastic stress that results from injection of the thermally controlled fluid colder than the formation is given by:

$$\sigma_{\Delta T} = \frac{\alpha E \Delta T \beta}{(1-2\nu)}, \tag{2}$$

where $\alpha$ is the coefficient of thermal expansion for reservoir rocks, E is the Young's modulus, $\nu$=Poisson's ratio, $\beta$ is the shape factor for the cooled region, i.e., $\beta>0$, and $\Delta T$ is the new temperature caused by the cooling fluid minus the reservoir temperature.

The magnitude of thermal stresses is proportional to the rock stiffness, thermal expansion coefficient, and the temperature change. The higher the temperature difference, the higher thermal stresses, the lower total stress, and the lower required breakdown pressure.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed:

1. A method of increasing hydrocarbon recovery from a wellbore penetrating a tight hydrocarbon formation, comprising:

injecting a fluid comprising an amide-based additive to reduce friction in the tight hydrocarbon formation;

inserting a hydro-jetting tool into the wellbore;

jetting a thermally controlled fluid against the wall of the wellbore, with reduced friction, to create a cavity in the wall, using the hydro-jetting tool;

subsequently injecting, through a coiled tubing and an annulus of the hydro-jetting tool, an amount of a proppant-laden slurry which is separate from the thermally controlled fluid into the wellbore such that the pressure in the wellbore increases and propagates one or more fractures extending from the cavity in the wall;

cooling the tight hydrocarbon formation using the proppant laden slurry by circulating the proppant-laden slurry within the cavity;

withdrawing the hydro-jetting tool from the wellbore; and recovering the thermally controlled fluid, the proppant-laden slurry, and one or more hydrocarbons from the fracture in the formation;

wherein the thermally controlled fluid contains an erosive material comprising acid, wherein the proppant-laden slurry is thermally controlled.

2. The method according to claim 1, wherein the thermally controlled fluid is at a temperature lower than the tight hydrocarbon formation.

3. The method according to claim 1, wherein the thermally controlled fluid comprises air, hydrogen, helium, sulfur hexafluoride, steam, or any inert gas.

4. The method according to claim 1, wherein the acid comprises hydrochloric acid, acetic acid, or any other acid with a pH less than 6.5.

5. The method according to claim 1, wherein the thermally controlled fluid comprises aqueous solutions of potassium chloride.

6. The method according to claim 1, wherein the thermally controlled fluid comprises gases, including $N_2$ and $CO_2$.

7. The method according to claim 1, wherein the thermally controlled fluid comprises liquids, such as aqueous solutions of potassium chloride and other brines or liquid $CO_2$.

8. The method according to claim 1, wherein the temperature of the thermally controlled fluid is at least 38° C. (100° F.) less than the temperature of the tight hydrocarbon formation.

9. The method according to claim 1, wherein the thermally controlled fluid has a temperature range of about −50° C. (−60° F.) to 5° C. (40° F.).

10. The method according to claim 1, wherein the pressure of the thermally controlled fluid is up to 2000 psi.

11. The method according to claim 1, wherein the pressure of the thermally controlled fluid is between 500 psi and 5,000 psi.

12. The method according to claim 1, wherein the cavities are formed radially outward in a horizontal portion of the wellbore.

13. The method according to claim 1, wherein the cavities are formed at an angle of less than 15° from a horizontal portion of the wellbore.

14. The method according to claim 1, wherein the cavities deviated less than 15° from a parallel alignment.

* * * * *